US008769852B2

(12) United States Patent
Coleman

(10) Patent No.: US 8,769,852 B2
(45) Date of Patent: Jul. 8, 2014

(54) FLASH SUPPRESSING AND RECOIL COMPENSATING MUZZLE DEVICE

(71) Applicant: William James Coleman, Stewartstown, PA (US)

(72) Inventor: William James Coleman, Stewartstown, PA (US)

( * ) Notice: Subject to any disclaimer, the term of this patent is extended or adjusted under 35 U.S.C. 154(b) by 0 days.

(21) Appl. No.: 13/683,451

(22) Filed: Nov. 21, 2012

(65) Prior Publication Data

US 2014/0137452 A1 May 22, 2014

(51) Int. Cl.
*F41A 21/00* (2006.01)

(52) U.S. Cl.
USPC ..... 42/1.06; 89/14.2; 89/14.3

(58) Field of Classification Search
USPC ..... 42/79; 89/14.2, 14.3, 14.4; D22/108
See application file for complete search history.

(56) References Cited

U.S. PATENT DOCUMENTS

| | | | | |
|---|---|---|---|---|
| 2,212,683 | A | 1/1937 | Hughes | |
| 2,870,679 | A * | 1/1959 | Collins | 89/14.2 |
| 2,900,875 | A * | 8/1959 | Fergus et al. | 89/14.3 |
| 4,664,014 | A * | 5/1987 | Hawley et al. | 89/14.2 |
| 5,005,463 | A * | 4/1991 | A'Costa | 89/14.2 |
| 5,596,161 | A * | 1/1997 | Sommers | 89/14.2 |
| 6,385,891 | B1 * | 5/2002 | Rabatin | 42/79 |
| 6,837,139 | B2 | 1/2005 | Meyers | |
| 7,302,774 | B2 | 12/2007 | Meyers | |
| 7,861,636 | B1 * | 1/2011 | Hoffman | 89/14.2 |
| 7,905,170 | B1 | 3/2011 | Brittingham et al. | |
| 8,490,534 | B1 * | 7/2013 | Moore | 89/14.2 |
| 2009/0178549 | A1 * | 7/2009 | Meyers | 89/14.2 |

* cited by examiner

*Primary Examiner* — Gabriel Klein
(74) *Attorney, Agent, or Firm* — Stetina Brunda Garred & Brucker

(57) ABSTRACT

A flash suppressing and recoil compensating muzzle device for use with a firearm provides a muzzle device that reduces recoil and inhibits muzzle flash while preventing audible harmonic resonant ringing after the firearm is discharged. The present invention accomplishes this through the use of an open ended muzzle device that redirects a portion of the high velocity gasses exiting the terminal end of the weapon through asymmetrically placed narrowing exhaust openings. The asymmetrically placed narrowing exhaust openings gradually direct exiting gases to the rear and to the sides of the muzzle in order to reduce recoil and reducing light emissions. The narrowing exhaust openings are formed by the radially positioned prongs of a distinct weight and width, which widen from the proximal to distal end of the muzzle device. The weight and mass disparity between prongs prevents audible ringing by reducing resonant vibrations between neighboring prongs.

13 Claims, 8 Drawing Sheets

FLASH SUPPRESSING AND RECOIL COMPENSATING MUZZLE DEVICE

FIELD OF THE INVENTION

The present invention relates generally to a muzzle device, more specifically to a flash suppressing and recoil compensating muzzle device for use with firearms, which through the arrangement of a plurality of prongs is able to effectively divert propellant gases in a manner that reduces muzzle flash and recoil upon discharging the weapon.

BACKGROUND OF THE INVENTION

Light emission and recoil are two undesirable side effects commonly experienced upon discharging a firearm. Both side effects can adversely affect the speed and accuracy of subsequent discharges from a firearm. Recoil is the backwards momentum felt by a shooter as a result of the forward momentum of the projectile and the expanding gases exiting the barrel. The backwards momentum felt by a shooter can directly impeded the ability of a shooter to maintain proper alignment with a target and cost valuable time in order to readjust alignment. Light emission produced upon discharging a firearm, commonly known as a muzzle flash, is the result of propellant gases containing oxidizable compounds exiting the barrel and making contact with ambient oxygen at temperatures sufficient to cause ignition. The resulting combustion produces an incandescent gas cloud of sufficient intensity capable of temporarily blinding a shooter during night time or low light conditions as well as potentially disclosing their position in a hostile situation.

While a variety of muzzle attachments have been developed in order to mitigate or eliminate muzzle flash and recoil, many of the devices fall short of addressing both side effects effectively. This situation is a result of the manner in which propellant gases are diverted upon exiting the barrel. To mitigate recoil, most muzzle devices divert propellant gases through openings that direct gases above and/or to the sides of the muzzle end of the bore line. These recoil mitigating devices are able to control the dispersion of propellant gases in a manner that reduces and counteracts the effects of recoil. Unfortunately one disadvantage experienced with some of these recoil mitigating devices is potentiating ignition of the propellant gases. On the other hand, some muzzle devices intended to reduce muzzle flash fail to manage recoil. Muzzle devices intended to reduce muzzle flash are able to do so by dispersing propellant gases through openings positioned circumferentially around the muzzle end of the bore line. These muzzle flash reducing devices are able to quickly disperse propellant gases in manner that reduces the temperature of the gases sufficiently preventing their combustion upon contacting ambient oxygen. Unfortunately, to reduce muzzle flash, the propellant gases are generally dispersed in a manner resulting in no significant compensation to recoil or muzzle climb.

Recoil reduction by redirecting gasses to the side or to the rear of the firearm has been well understood for many years. For instance, Hughes U.S. Pat. No. 2,212,683 'Control For Recoil' is one of the earliest patents approved for a muzzle mounted device that redirects the propellant gases in a manner which reduces recoil felt by a shooter. While it has long been understood that recoil can be reduced by redirecting propellant gases to the side and the rear of a weapon, historically, these attempts not been able to mitigate muzzle flash intensity. Although there have been several designs that have sought to overcome this disadvantage, few designs have achieved significant success. As a result of this situation, many muzzle devices have abandoned recoil management in favor of flash suppression. Currently flash suppression devices exist in two common configurations an open suppressor configuration and a bird cage configuration. The open ended configurations comprise a plurality of prongs positioned radially around the muzzle end of the bore line. The birdcage configuration is similar to the open configuration with the exception that the prongs feature a ring on the distal of the muzzle device that binds the ends of the prongs together forming a caged structure. Currently open ended style muzzle devices, such as those by of Advanced Armament Corp., LLC (Brittingham U.S. Pat. No. 7,905,170), BE Meyers (Meyers U.S. Pat. No. 6,837,139 and Meyers U.S. Pat. No. 7,302,774) and Smith Enterprises (Sommers U.S. Pat. No. 5,596,161) all effectively suppress flash, but lack effective recoil management. Such open end muzzle devices also have a tendency to ring loudly after firing, as a result of harmonic resonance between the prongs positioned radially around the bore line. This lingering sound is an undesired side effect of current flash suppressing muzzle devices. This distinct sound signature produced by current flash suppressing muzzle devices is at best a subtle annoyance and at worst an audible indicator for locating the position of the firearm operator.

It is therefore the object of the present invention to provide a muzzle device that reduces effects of recoil and inhibits muzzle flash while preventing audible harmonic resonant ringing. The present invention accomplishes this through the use of an open ended muzzle device that redirects a portion of the high velocity gasses exiting the terminal end of the weapon through asymmetrically placed narrowing exhaust openings. The asymmetrically placed narrowing exhaust openings reduce light emissions by allowing propellant gases to cool prior to mixing with ambient air and redirecting the exiting gases to the side with an upward bias reducing recoil. Furthermore, the asymmetric placement of the narrowing exhaust openings allows the prongs to be of variable size which reduce the production of audible harmonic resonant ringing. Additional resistance to resonant ringing is achieved by unequal volume cavities located at the distil ends of the prongs which further alter vibration characteristics.

BRIEF DESCRIPTIONS OF THE DRAWINGS

DETAIL DESCRIPTIONS OF THE INVENTION

All illustrations of the drawings are for the purpose of describing selected versions of the present invention and are not intended to limit the scope of the present invention.

Figure 1:
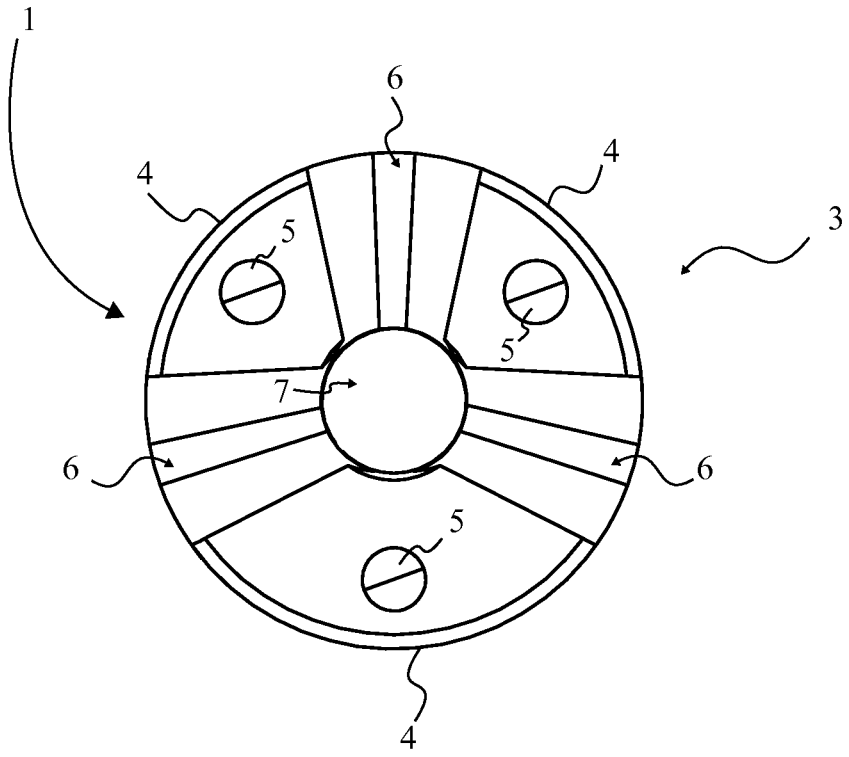
FIG. 1 is a front elevational view displaying the arrangement between the at least three distinct prongs, the at least three distinct narrowing voids, and the bore as per the current embodiment of the present invention.
Figure 2:
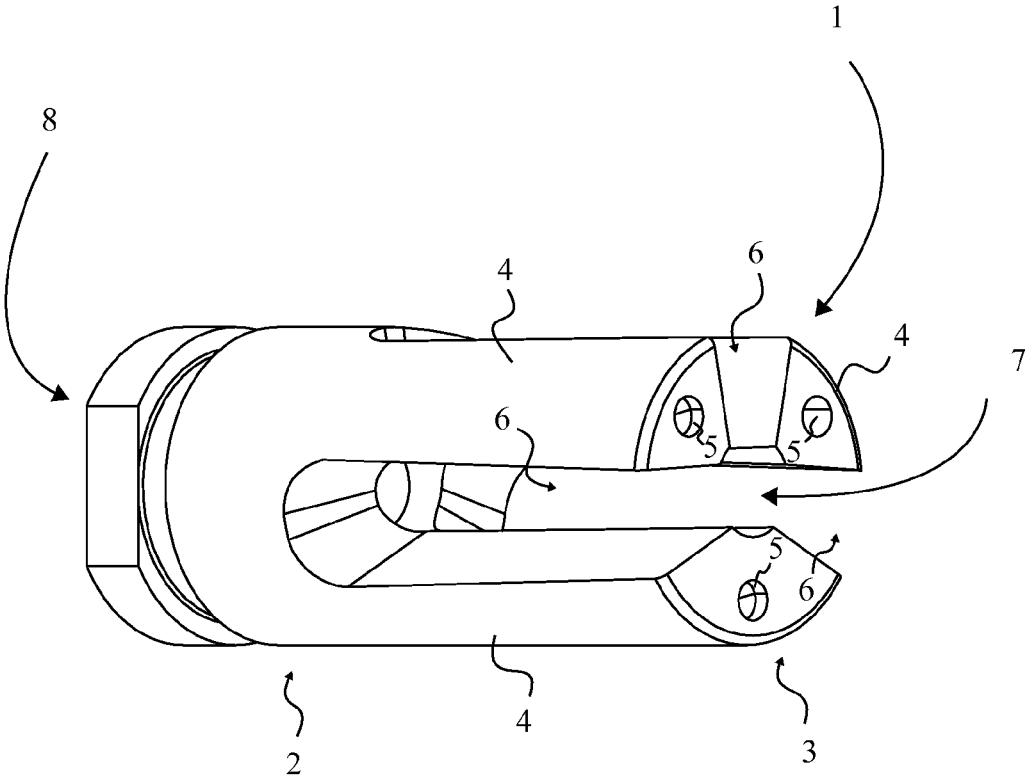
FIG. 2 is a right side perspective view displaying the relationship between the cylindrical open ended structure, the bore, and the terminal end mount as per the current embodiment of the present invention.

Referencing FIG. 1 and FIG. 2, the present invention is a combination muzzle device that is found at the terminal end of a firearm's barrel in order to mitigate recoil and reduce muzzle flash after discharging the firearm. The present invention accomplishes this while preventing audible ringing due to harmonic resonance. The combination muzzle device comprises a cylindrical open ended structure 1, a bore 7, and a terminal end mount 8. The cylindrical open ended structure 1 allows the escape of propellant gases in a fan pattern that substantially decreases light emissions and dampens recoil upon discharge of the firearm. The terminal end mount 8 is coupled to the terminal end of a firearm's barrel. The terminal end mount 8 is found positioned concentrically with the cylindrical open ended structure 1. The bore 7 is the channel in which a projectile and propellant gases traverse while exiting the combination muzzle device. The bore 7 is found traversing through both the terminal end mount 8 and the cylindrical open ended structure 1. The bore 7 is traverse the terminal end mount 8 and the cylindrical open ended structure 1 along a proximal-distal axis found along the cylindrical open ended structure 1.

Referencing FIG. 2, the cylindrical open ended structure 1 of the present invention comprises a proximal end 2, a distal end 3, at least three distinct prongs 4, and at least three distinct narrowing voids 6. The proximal end 2 and the distal end 3 are used to define the longitudinal axis of the cylindrical open ended structure 1. The proximal end 2 and the distal end 3 are used to section the cylindrical open ended structure 1 as two regions wherein the proximal end 2 is the region closest to terminal end mount 8 while the distal end 3 is the region furthest from the terminal end mount 8. The at least three distinct prongs 4 and the at least three distinct voids are the primary component that allow the combination muzzle device to redirect the flow of propellant gasses. At the proximal end 2, the at least three distinct prongs 4 and the at least three distinct narrowing voids 6 are coupled to the terminal end mount 8. At the distal end 3, the at least three distinct prongs 4 and the at least three distinct narrowing voids 6 are only in contact with themselves. This arrangement at the distal end 3 provides the cylindrical open ended structure 1 with its "open muzzle device" configuration.

Figure 3:
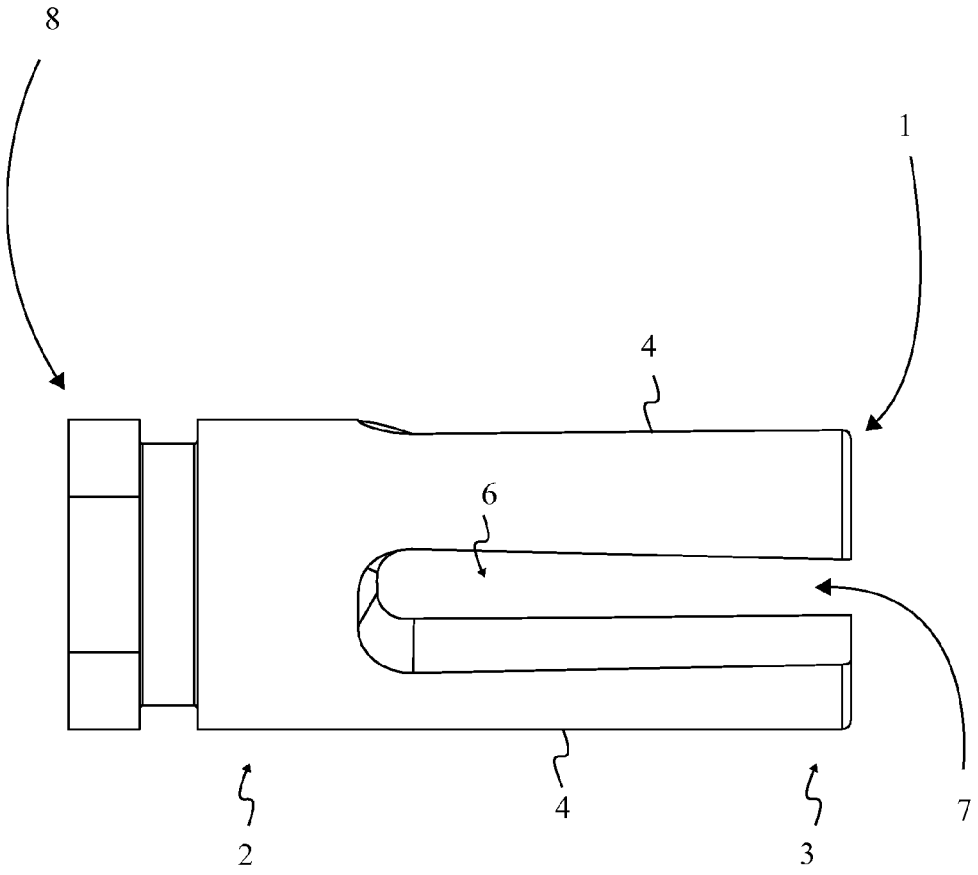
FIG. 3 is a side view displaying the at least three distinct prongs and the at least three distinct narrowing voids along the proximal-distal axis as per the current embodiment of the present invention.
Figure 4:
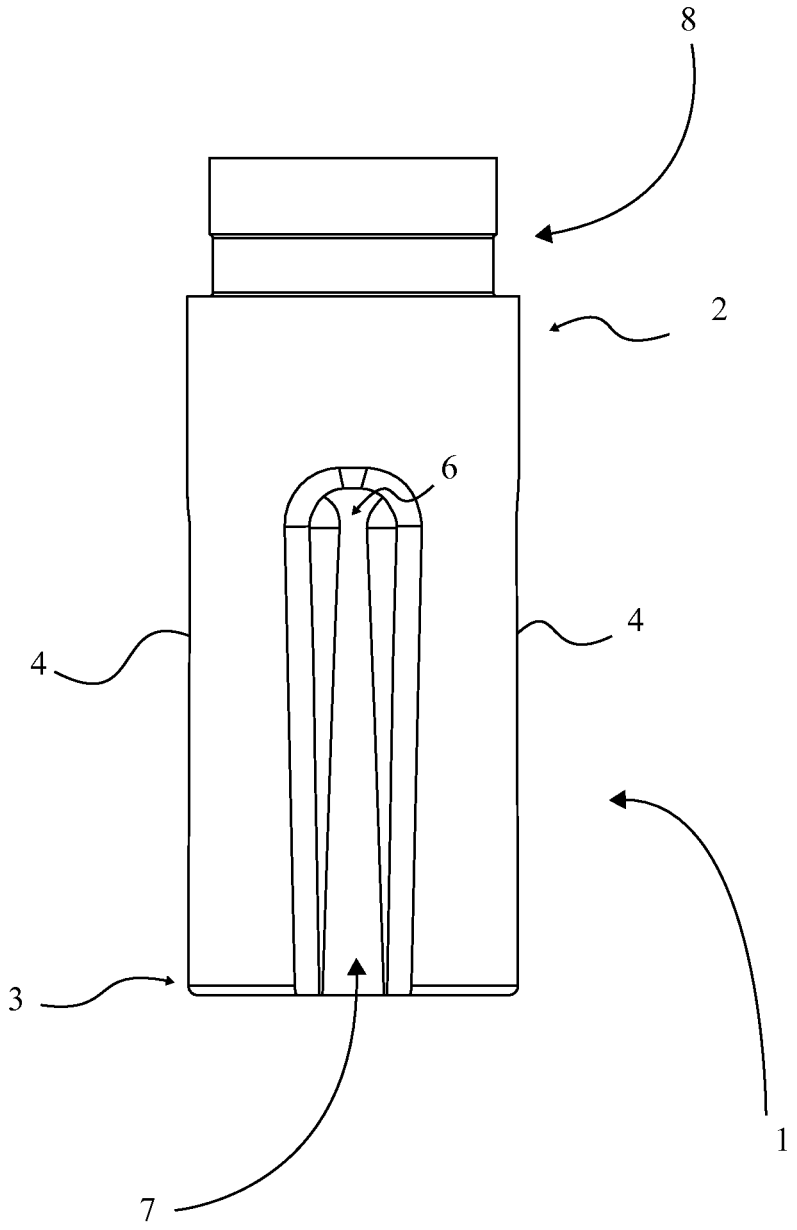
FIG. 4 is a top elevational view displaying the at least three distinct prongs and the at least three distinct narrowing voids along the proximal-distal axis as per the current embodiment of the present invention.
Figure 5:
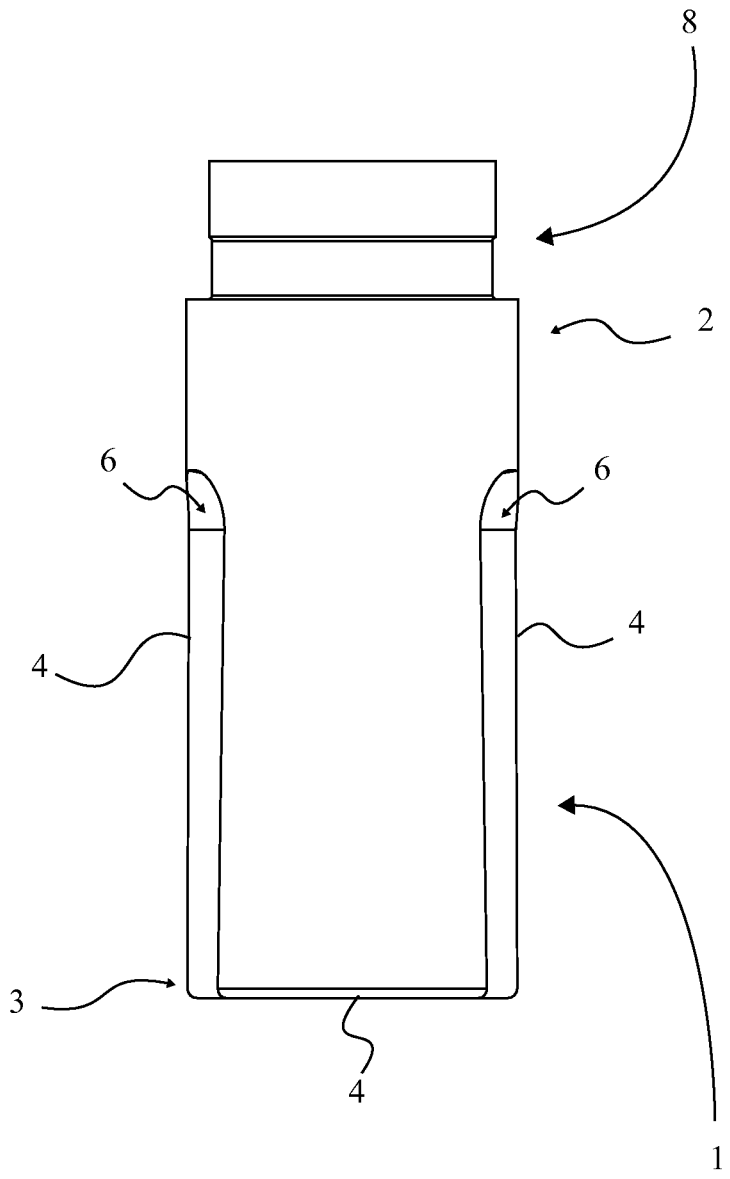
FIG. 5 is a bottom elevation view displaying the at least three distinct prongs and the at least three distinct narrowing voids along the proximal-distal axis as per the current embodiment of the present invention.

Referencing FIG. 3-5, the at least three distinct prongs 4 are geometrically shaped features that are found radially positioned around the bore 7. The at least three distinct prongs 4 extend the length of the cylindrical open ended structure 1 from the proximal end 2 to the distal end 3. It should be noted that references to a particular of the at least three distinct prongs 4 is hereinafter referred to as a prong 4 unless otherwise specified. Each prong 4 is of a variable width relative to another prong 4, wherein at least one prong 4 within the cylindrical open ended structure 1 is unequal in width to at least another prong 4 within the cylindrical open ended structure 1. Each prong 4 increases in width from the proximal end 2 to the distal end 3, wherein the average width of the distal half of each the prong 4 exceeds the average width of the proximal half. Each of the at least three prongs 4 are of equal length but at least one of the at least three prongs 4 is of unequal mass distribution. The unequal mass distribution provides a means to mitigate resonant vibrations during the firing of the weapon. To further accomplish this unequal mass distribution, at least one of the at least three prongs 4 contains a cavity 5. The cavity 5 of a prong 4 is variable in geometry and volume to the cavity 5 of at least one of the at least three distinct prongs. The variable geometry and volume of the cavity 5 creates a disparity between the mass of at least two of the at least of the at least three prongs 4. Resultantly, the disparity results in noticeable reduction in audible ringing due to resonant vibration.

Referencing FIG. 3-5, the at least three distinct narrowing voids 6 are interstitial voids that are radially positioned around the bore 7. The at least three distinct narrowing voids 6 extend the length of the cylindrical open ended structure 1 from the proximal end 2 to the distal end 3. It should be noted that references to a particular of the at least three distinct narrowing voids 6 is here in after referred to as a narrowing void 6 unless otherwise specified. Each narrowing void 6 decreases in volume from the proximal end 2 to the distal end 3, wherein the volume of the proximal half of each narrowing void 6 exceeds the volume of the distal half of each narrowing void 6.

Figure 6:
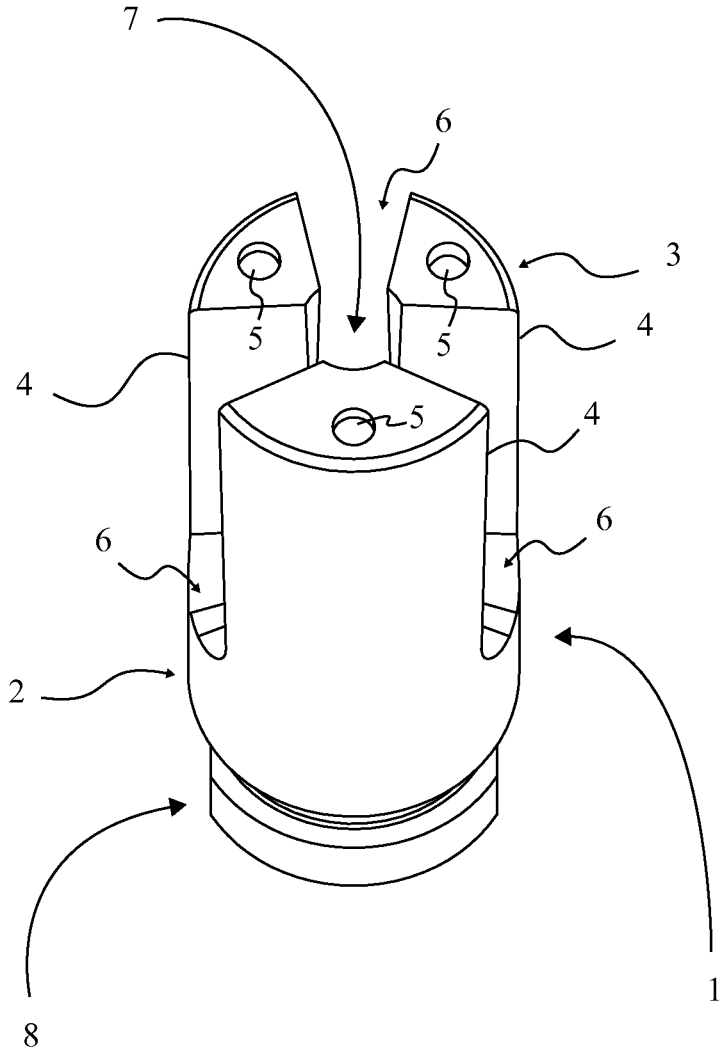
FIG. 6 is a bottom perspective view displaying the relationship between the at least three distinct prongs and the at least three distinct narrowing voids as per the current embodiment of the present invention
Figure 7:
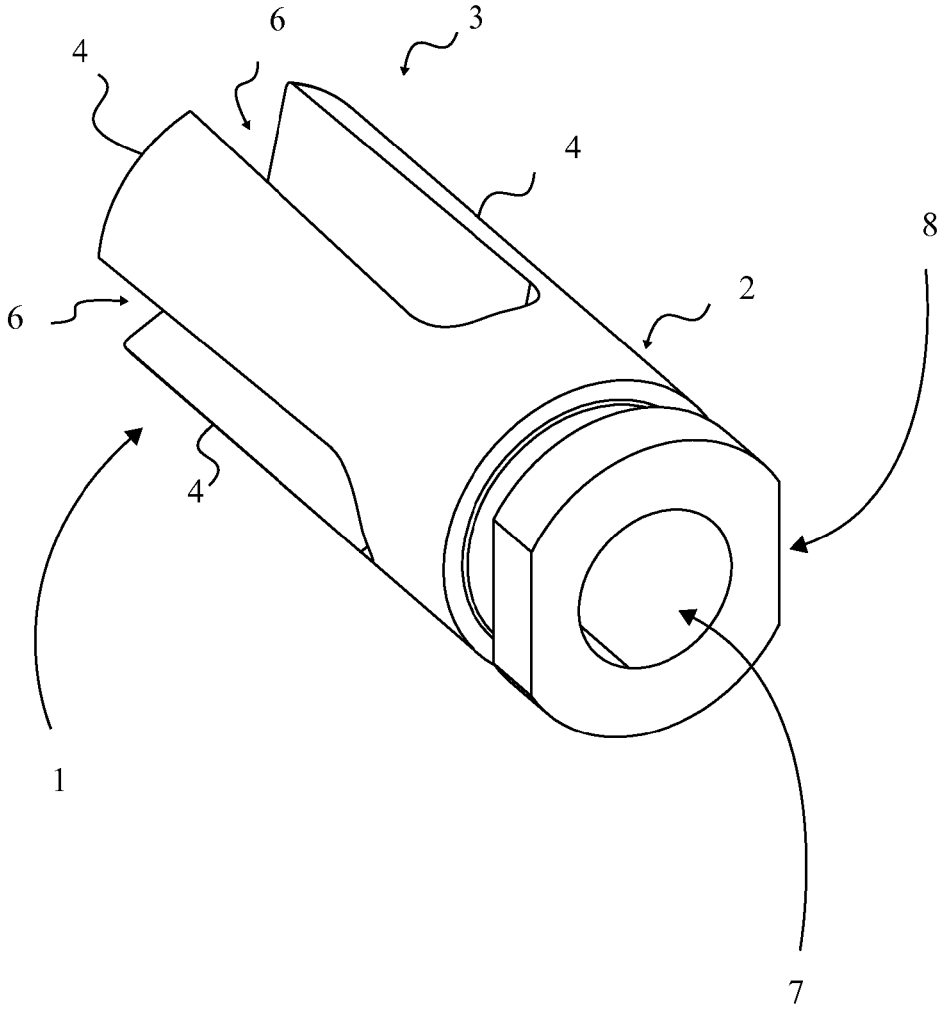
FIG. 7 is a rear perspective view displaying the bore, the terminal end mount, and the cylindrical open ended structure as per the current embodiment of the present invention.

Referencing FIG. 1 and FIG. 6, the at least three distinct prongs 4 positioned radially around the bore 7 are spaced asymmetrically, wherein the angular measurement between a set of prongs is unequal to the angular measurement between another set of prongs 4. The at least three distinct narrowing voids positioned radially around the bore 7 are spaced asymmetrically, wherein the angular measurement between a set of narrowing voids 6 is unequal to the angular measurement between another set of narrowing voids 6. The at least three distinct narrowing voids 6 and the at least three distinct prongs 4 are found positioned in alternating co-radial sequence around the bore 7, wherein the alternating co-radial sequence positions each narrowing void 6 between two prongs 4 and positions each prong 4 between two narrowing voids 6.

Referencing FIG. 4, in the present invention the at least three distinct narrowing voids 6 are able to beneficially redirect propellant gases prior to contacting ambient air by creating progressively greater resistance to the flow by decreasing in volume towards the distal end 3. This resistance to gas flow towards the distal end 3 of the device causes a gradual change in flow that directs the exiting gases perpendicularly out to sides of the device. As a result, exiting gases gradually mix with ambient air and cool without producing visible illumination. Furthermore, by diverting the flow of exiting gases to the rear and/or the sides of the device, the present invention is able to reduce forward gas flow which is largely responsible for recoil. Additionally, by diverting exiting gases to the rear and to the sides the present invention is able to provide an opposing force that partially counteracts the momentum of the forward gas flow.

In the present invention the variable width and mass of each of the at least three prongs 4 is able to deter the resonant vibrations which generate the ringing sounds upon discharging a firearm. The variable width and mass are able to produce the resonant vibrations for each prong 4 that create destructive interference.

Figure 8:
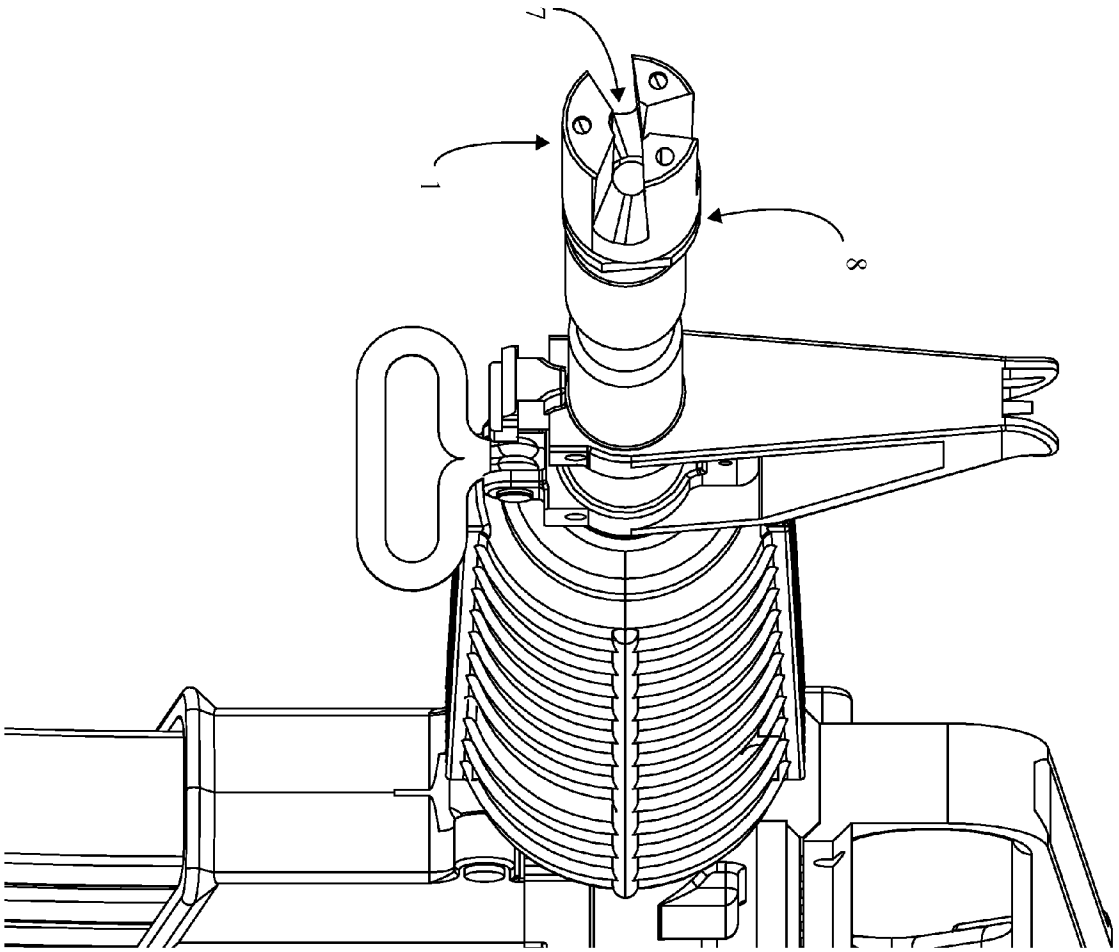
FIG. 8 is a perspective view displaying the present invention mounted on a M4 carbine.

Referencing FIG. 8, the current embodiment of the present invention the combination muzzle device is designed for use with weapon systems related to the AR-15 platform. Specifically, the current embodiment of the present invention is intended for use with the M4 carbine and its variants. The specifications of the M4 carbine require the bore 7 and the terminal end mount 8 to be chambered and configured in order function properly. The M4 carbine has a barrel chambered for the 5.56×45 mm North American Treaty Organization (NATO) rifle cartridge. This specification requires the bore 7 of the present invention to be of adequate diameter in order to accommodate the 5.56×45 mm round. Furthermore, the terminal end of the M4 carbine is threaded by a ½"×28 Turns Per Inch (TPI) thread, requiring the terminal end mount 8 to have a threaded opening compatible with the ½"×28 TPI male thread in order to properly fasten with the M4 Carbine.

In the current embodiment of the present invention the terminal end mount 8 is the coupling point between the combination muzzle device and the terminal end of a firearm's barrel. The terminal end mount 8 can accomplish this relationship through a plurality of manners which include but are not limited being fastened to the terminal end of the barrel by a threaded mount, pinned, or welded as well as any combination thereof. Furthermore the terminal end mount 8 can be machined into the terminal end of the barrel.

In the current embodiment of the present invention the muzzle device is designed for small and medium caliber firearms without adding undue length or mass, while allowing for the mounting of specific types of sound suppression attachments. To accomplish this feature, the present invention is configured as a cylindrical muzzle device that is approximately 3" inches in length with an approximate diameter of ⅞" of an inch when attached to the terminal end of an M4 carbine.

In the preferred embodiment of the present invention the bore 7 increases in diameter from the proximal end 2 to the distal end 3. Increasing the diameter of the bore 7 ensure that a projectile will not make contact with the device while it traverses through. Specifically, the diameter of the bore 7 increases by a half degree from the proximal end 2 towards the distal end 3.

In an additional embodiment of the present invention, the relative dimension of the bore 7, the terminal end mount 8, and the cylindrical open ended structure 1 may be appropriately scaled in order to accommodate firearms chambered in plurality of cartridge dimensions. These dimension can include but are not limited to 0.300 AAC, 0.223 Remington, 0.308 Winchester, 7.62×51 mm, 0.45 ACP, 6.8 SPC, 0.338 Lapua, and 5.45×39 mm as well as developed or yet to be developed cartridge calibers.

In an additional embodiment of the present invention, the at least three distinct prongs 4 can be constructed of equal width. While the present invention has the at least three prongs 4 of unequal width in order to create and asymmetrical co-radial positioning for the at least three distinct narrowing voids 6, and additional could employ equal width construction to the at least three prongs 4. The current construction provides the present invention with the ability to directionally vent exhausted propellant gases. The alteration to the asymmetrical positioning, specifically alterations that resulted in a symmetrical positioning of the narrowing voids 6 would create a non-directional bias for the exhausted propellant gas.

In an additional embodiment of the present invention the at least three narrowing voids 6 can be inclined to either side of the bore 7 axis. While the present invention provides the narrowing voids 6 in a manner that places them in line with the bore 7 axis, an additional embodiment can provide the at least three narrowing voids 6 in a manner that inclines positioning relative to the bore 7 axis. Although this additional configuration is provided to allow variation to the current embodiment of the present invention, it should be understood that as long as the narrowing voids 6 decrease in volume as they approach the distal end 3, angular variations should be considered an obvious difference.

In an additional embodiment of the present invention, narrowing voids 6 can be configured to narrow asymmetrically. While in the present invention the narrowing voids 6 diverge and converge symmetrically for ease of machining, the additional embodiment allows the narrowing voids 6 to be diverging and converge asymmetrically. By providing an asymmetrical convergence and divergence for the narrowing voids 6 the present invention can be configured specifically for a particular application.

In an additional embodiment of the present invention reliefs may be added to the external device body or the profile otherwise altered to decrease debris binding with sound suppressor attachments. The current embodiment of the present invention provides the at least three distinct prongs 4 as being of equal length allowing for the present invention to be easily sleeved by barrel accessories. In the additional embodiment the present invention would be configured to facilitate the attachment of a sound suppressor.

Although the invention has been explained in relation to its preferred embodiment, it is to be understood that many other possible modifications and variations can be made including machining the device directly into the barrel without departing from the spirit and scope of the invention as hereinafter claimed.

What is claimed is:

1. A flash suppressing muzzle device for use at a terminal end of a barrel of a firearm, the device comprising:

a body having a proximal mounting portion and at least three distinct prongs extending from the proximal mounting portion in a cantilever configuration, the proximal mounting portion and the at least three distinct prongs having a through hole through which a bullet travels in a direction from the proximal mounting portion to the at least three distinct prongs, the through hole defining a central axis, the at least three prongs circumferentially disposed about the central axis, at least three distinct voids each void defined between two immediately adjacent distinct prongs and having a longitudinally narrowing configuration in a direction from the proximal mounting portion to the at least three distinct prongs for mitigating visible illumination upon firing of a cartridge to propel the bullet through the barrel of the firearm and the through hole of the flash suppressing muzzle device;

the proximal mounting portion of the device attachable to the terminal end of the barrel of the firearm with the at least three distinct prongs extending in front of the barrel of the firearm and the proximal mounting portion of the flash suppressing muzzle device.

2. The flash suppressing muzzle device for use at the terminal end of a firearm's barrel as claimed in claim 1 wherein:

the central axis of the device is positioned coaxially with a bullet travel axis of a bore of the firearm's barrel when the proximal mounting portion is mounted to the terminal end of the barrel of the firearm.

3. The flash suppressing muzzle device for use at the terminal end of a firearm's barrel as claimed in claim 1 wherein:

each distinct prong of the at least three distinct prongs increasing in width from a proximal end to a distal end, wherein the average width of the distal half of each distinct prong exceeds the width of the proximal half of each distinct prong; and each distinct narrowing void of the at least three distinct narrowing voids decreases in volume from the proximal end to the distal end, wherein the volume of the proximal half of each distinct narrowing void exceeds the volume of the distal half of each distinct narrowing void;

any two adjacent prongs of the at least three distinct prongs are attached to the proximal mounting portion with a curvature that starts the void defined by the two adjacent prongs.

4. The flash suppressing muzzle device for use at the terminal end of a firearm's barrel as claimed in claim 1 wherein:

the at least three distinct prongs being radially positioned around the central axis, wherein the at least three distinct prongs extend from a proximal end to a distal end of the body;

the at least three distinct narrowing voids being radially positioned around the central axis, wherein the at least three distinct narrowing voids extend from the proximal end to the distal end of the body; and the at least three distinct prongs and the at least three distinct narrowing voids are positioned in an alternating co-radial sequence, wherein each of the at least three distinct prongs being positioned between a distinct narrowing void and another distinct narrowing void of the at least three distinct narrowing voids and where each of the at least three distinct narrowing voids being positioned between a distinct prong and another distinct prong of the at least three distinct prongs.

5. The flash suppressing muzzle device for use at the terminal end of a firearm's barrel as claimed in claim 4 wherein, the at least three distinct prongs being spaced asymmetrically, wherein each angular relationship between two distinct prongs of the at least three distinct prongs being disproportionate to another angular relationship between two distinct prongs of the at least three prongs; and the at least three distinct narrowing voids being spaced asymmetrically around the bore, wherein each angular relationship between two distinct narrowing voids of the at least three distinct narrowing voids being disproportionate to another angular relationship between two distinct narrowing voids of the at least distinct narrowing voids.

6. The flash suppressing muzzle device for use at the terminal end of a firearm's barrel as claimed in claim 4, wherein the at least three distinct narrowing voids being positioned in a directionally biased manner that directs the flow of propellant gases to the rear and sides of a firearms terminal end resulting in a reduction in recoil.

7. The flash suppressing muzzle device for use at the terminal end of a firearm's barrel as claimed in claim 1 wherein:

each distinct prong of the at least three distinct prongs being of equal length but unequal mass distribution compared to at least one distinct prong of the at least three distinct prongs, wherein the unequal mass distribution of each distinct prong compared to at least one distinct prong of the at least three distinct prongs is provided to mitigate resonant vibrations upon firing.

8. The flash suppressing muzzle device for use at the terminal end of a firearm's barrel as claimed in claim 7 wherein:

each of the at least three distinct prongs comprises a cylindrical hole disposed at a front end surface, wherein each of the cylindrical holes are at a different depth from the front end surface to mitigate resonant vibrations upon firing.

9. A firearm comprising:

a receiver and a barrel attached to the receiver with a bullet having a travel direction from the receiver to the barrel along a bore axis of the barrel, the barrel defining a terminal end;

a flash suppressing muzzle device at the terminal end of the barrel of the firearm, the device comprising:

a body having a proximal mounting portion and at least three distinct prongs extending from the proximal mounting portion in a cantilever configuration, the proximal mounting portion and the at least three distinct prongs having a through hole through which the bullet travels in a direction from the proximal mounting portion to the at least three distinct prongs, the through hole defining a central axis, the at least three prongs circumferentially disposed about the central axis, at least three distinct voids, each void defined between two immediately adjacent distinct prongs and having a longitudinally narrowing configuration in a direction from the proximal mounting portion to the at least three distinct prongs from mitigating visible illumination upon firing of a cartridge to propel the bullet through the barrel of the firearm and the through hole of the flash suppressing muzzle device;

the proximal mounting portion attachable to the device to the terminal end of the barrel of the firearm with the at least three distinct prongs extending in front of the barrel of the firearm.

10. The firearm as claimed in claim 9 wherein:

each distinct prong of the at least three distinct prongs increasing in width from a proximal end to a distal end, wherein the average width of the distal half of each distinct prong exceeds the width of the proximal half of each distinct prong; and each distinct narrowing void of the at least three distinct narrowing voids decreases in volume from the proximal end to the distal end, wherein the volume of the proximal half of each distinct narrowing void exceeds the volume of the distal half of each distinct narrowing void.

11. The firearm as claimed in claim 9 wherein:

the at least three distinct prongs being radially positioned around the central axis, wherein the at least three distinct prongs extend from a proximal end to a distal end of the body;

the at least three distinct narrowing voids being radially positioned around the central axis, wherein the at least three distinct narrowing voids extend from the proximal end to the distal end of the body; and the at least three distinct prongs and the at least three distinct narrowing voids are positioned in an alternating co-radial sequence, wherein each of the at least three distinct prongs being positioned between a distinct narrowing void and another distinct narrowing void of the at least three distinct narrowing voids and where each of the at least three distinct narrowing voids being positioned between a distinct prong and another distinct prong of the at least three distinct prongs.

12. The firearm as claimed in claim 11 wherein:

the at least three distinct prongs being spaced asymmetrically, wherein each angular relationship between two distinct prongs of the at least three distinct prongs being disproportionate to another angular relationship between two distinct prongs of the at least three prongs;

the at least three distinct narrowing voids being spaced asymmetrically around the bore, wherein each angular relationship between two distinct narrowing voids of the at least three distinct narrowing voids being disproportionate to another angular relationship between two distinct narrowing voids of the at least distinct narrowing voids; and wherein the at least three distinct narrowing voids being positioned in a directionally biased manner that directs the flow of propellant gases to the rear and sides of a firearms terminal end resulting in a reduction in recoil.

13. The firearm as claimed in claim 9 wherein:

each distinct prong of the at least three distinct prongs being of equal length but unequal mass distribution compared to at least one distinct prong of the at least three distinct prongs, wherein the unequal mass distribution of each distinct prong compared to at leant one distinct prong of the at least three distinct prongs is provided to mitigate resonant vibrations upon firing; and at least one distinct prong of the at least three distinct prongs comprises a cavity disposed at a front end of the at least one distinct prong, wherein the cavity of the at least one distinct prong varies in geometry and volume in order to mitigate resonant vibrations upon firing.

* * * * *